United States Patent [19]

Hershkowitz et al.

[11] 4,110,136

[45] Aug. 29, 1978

[54] EXPLOSIVES CONTAINING AMMONIUM NITRATE AND NITRATED AMINES

[75] Inventors: Joseph Hershkowitz, West Caldwell, N.J.; Irving B. Akst, Pampa, Tex.

[73] Assignee: The United States of America as represented by the Secretary of the Army, Washington, D.C.

[21] Appl. No.: 769,607

[22] Filed: Feb. 17, 1977

[51] Int. Cl.[2] ..... C06B 31/32

[52] U.S. Cl. ..... 149/47; 149/92

[58] Field of Search ..... 149/47, 88, 92

[56] References Cited

U.S. PATENT DOCUMENTS 3,378,576 4/1968 Dinwoodie et al. ..... 149/88 X

*Primary Examiner*—Stephen J. Lechert, Jr.

*Attorney, Agent, or Firm*—Nathan Edelberg; Robert P. Gibson; A. Victor Erkkila

[57] ABSTRACT

An explosive composition containing essentially of an intimate mixture of 15 to 45% by weight of a particulate high explosive from the group consisting of RDX (1,3,5-trinitro-1,3,5-triazacyclohexane) and HMX (1,3,5,7-tetranitro-1,3,5,7-tetraazacyclooctane and mixtures thereof, 15 to 50% by weight of ammonium nitrate, and 20 to 60% by weight of ethylenediamine dinitrate;

wherein the weight ratio of ammonium nitrate to ethylenediamine dinitrate is from 1:2.5 to 1.5:1, respectively, and particularly about 1:1. These explosive compositions provide an unexpectedly high explosive output with a relatively low content of RDX and/or HMX, and an equivalent output with much less RDX than conventional explosive compositions consisting of mixtures of RDX with AN and/or TNT.

8 Claims, 2 Drawing Figures

EXPLOSIVES CONTAINING AMMONIUM NITRATE AND NITRATED AMINES

GOVERNMENTAL INTEREST

The invention described herein was made in the course of a contract with the Government and may be manufactured, used and licensed by or for the Government for governmental purposes without the payment to us of any royalty thereon.

BACKGROUND OF THE INVENTION

It is known to produce explosive mixtures of good homogeneity suitable for the production of cast explosive charges by melting together ammonium nitrate (AN) and an aliphatic mono-or polyamine nitrate, e.g. methylammonium nitrate (MAN) and ethylenediamine dinitrate (EDD) (U.S. Pat. No. 1,968,158). Such low-melting mixtures including eutectic mixtures, with and without other explosive and inert additives e.g. PETN, RDX or TNT were utilized as cast explosive charges by Germany in World War II and more recently have been the object of further studies. (T. Urbanski, "Chemistry and Technology of Explosives", Pergamon Press, Vol III, pp 253–4 and 271; B. T. Federoff and O. E. Sheffield, "Encyclopedia of Explosives and Related Items," Technical Report 2700, Volume 6 (1974), pp E234–7; M. H. Ficheroulle, "Ethylenedinitramine, Ammonium Ethylenedinitramate, Binaries with Ammonium Nitrate," *Memorial des Poudres,* 30, 89–100 (1948) (In French); A. LeRoux, "Explosive Properties of Ethylenediamine Dinitrate," *Memorial des Poudres,* 32, 121–131 (1950); A. LeRoux, "Explosive Properties of Nitrate of Monomethylamine," *Memorial des Poudres,* 34, 129–145 (see pp. 141–2 for EDD) (1952); B. T. Federoff et al, "Dictionary of Explosives, Ammunition and Weapons (German Section)," Technical Report 2510, Picatinny Arsenal Dover, N.J. pp. Ger 35-36, 47, 48 (1959) (AD 16036); "Allied and Enemy Explosives," Aberdeen Proving Ground Report APG ST-9-2900-1 (1946), pp 145–147; and A. N. Campbell and A. J. R. Campbell, "Binary and Ternary Eutectics Involving Ammonium Nitrate," Canadian Journal Research, Vol. 25B pp. 90–100 (1947)).

It has also been recognized that established explosive compositions such as Amatols (AN/TNT 60/40), and Amatex 20 and 40 (RDX/TNT/AN, 20/40/40 and 40/40/20) perform as though only 19%, 50% and 50%, respectively, of the AN in the compositions participates and contributes to the explosive output (C. F. Mader, "An Equation of State for Nonideal Explosives," Los Alamos Scientific Laboratory, LA5864, April 1975).

SUMMARY OF THE INVENTION

A principal object of the present invention is to increase the participation of AN in composite explosives so as to provide a superior explosive output. Another object is to provide composite explosive compositions containing AN, which provide unexpectedly high explosive performance with a relatively small content of RDX, can be readily made from industrially available materials by existing technology with reduced hazard, possess good storage stability and can be cast, molded or pressed into suitable shapes, such as pellets.

It has been found that the foregoing and other objects can be achieved according to the present invention by means of an explosive composition consisting essentially of 15 to 45% by weight of a particulate high explosive selected from the group consisting of 1,3,5-trinitro-1,3,5-triazacyclohexane (RDX) and 1,3,5,7-tetranitro-1,3,5,7-tetraazacyclooctane (HMX), and mixtures thereof, 15–50% by weight of ammonium nitrate (AN), and 20–60% by weight of ethylenediamine dinitrate (EDD), wherein the AN and EDD components are present in the weight ratio of from 1:2.5 to 1.5:1, respectively, particularly about 1:1, and at least in part as an intimate mixture obtained by cosolidification.

DETAILED DESCRIPTION OF THE INVENTION

Figure 2:
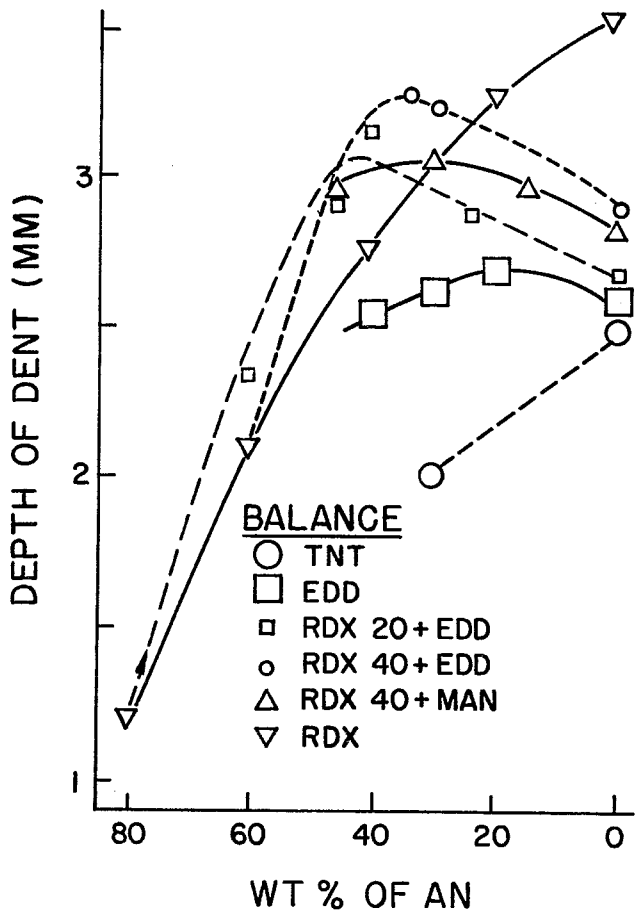
FIG. 2 sets forth a series of graphs showing the depth of dent produced versus the AN content of various explosive compositions, including compositions of the present invention. de

The novel explosive compositions of the present invention contain all or part of the EDD and AN components as an intimate mixture obtained by cosolidification as more fully described hereinafter. Due to their content of such intimate mixtures and critical proportions of EDD and AN in combination with at least 15% of RDX and/or HMX, the novel explosive compositions generally provide a greater output, as measured by depth of dent, for the same detonation velocity than (1) similar explosive compositions, wherein the EDD/AN mixture is present in other proportions and/or obtained by other methods, e.g. mechanical mixing of the finely powdered dry ingredients and (2) mixture of RDX with AN or TNT containing much higher contents of RDX. The role of the RDX and/or HMX is to provide a highly energetic component, which will provide a high pressure and high temperature, wherein the intimate mixture of AN and EDD will be caused to act synergistically.

The intimate mixture of the EDD and AN can be obtained by cosolidification as follows. A mixture, of AN and EDD in the weight ratio of from 1:2.5 to 1.5:1 respectively, is heated to a temperature somewhat above the melting point of the EDD/AN mixture until melting occurs and a smooth blend is produced. The molten mixture, which may then be admixed with finely divided RDX and/or HMX, is cooled to solidify the melt. This can be accomplished by pouring the melt into a cold mold, or onto a cold stainless steel sheet or by mixing the melt with a cold inert liquid, e.g. Freon, to form finely divided particles. According to a preferred process, a eutectic mixture of EDD and AN, preferably together with finely divided particles of RDX and/or HMX, is suspended in a carrier liquid in which the EDD and AN ingredients are insoluble, e.g. perchloroethylene. The agitated suspension is then heated to a temperature above the eutectic temperature (e.g. about 10°–15° C above the melting point of the eutectic, which is approximately 103° C) and held thereat for several minutes until the EDD and AN ingredients are completely melted and coalesced. Cold carrier liquid, which may be the same or different from that employed as the suspension liquid, is then rapidly added sufficient to drop the temperature, say about 10° C, below the eutectic temperature as suddenly as possible, thereby causing the eutectic to solidify largely as a coating on the finely divided particles of RDX and/or HMX. The product thus obtained generally consists of small particles requiring no further grinding.

The term consolidification, as used in the present invention, is understood to include (1) a process, wherein the EDD/AN mixture in the presence or absence of a non-solvent type carrier liquid is heated above the melting point of the mixture and cooled to solidify i.e. cocrystallize the mixture, as well as (2) a process wherein the EDD/AN mixture is cocrystallized from solution in a solvent. For example, the EDD and AN, preferably in about the proportions of the eutectic mixture, are dissolved in a suitable solvent, e.g. water, after which RDX and/or HMX and other ingredients insoluble in the solvent can be added. Thereafter the solution is evaporated to dryness under heat and vacuum to remove the solvent and cocrystallize the EDD/AN mixture, and the product is pulverized for further use.

Also, the EDD/AN eutectic mixture can be first prepared by cosolidification as previously described and additional AN or EDD then added to obtain the desired proportions. The resulting mixtures can be crushed or pulverized to the desired fineness, dry-mixed with RDX and/or HMX and finally pressed into pellets.

The compositions thus obtained can be mixed with small amounts of waxes, surfactants, anti-hydroscopic agents, casting or bonding agents, etc. as needed or desired, to provide desensitization, dimensional stability, reduced caking, amd improved casting and bonding properties, as known in the art.

The preferred EDD/AN/RDX (HMX) compositions of the present invention are those wherein substantially all of the AN and EDD components are present as a eutectic obtained by cosolidification, wherein the EDD/AN eutectic mixture is heated above its melting point and the melted mixture is cooled to below its solidification point. Such explosive compositions, wherein substantially all of the AN and EDD are present as a cosolidified eutectic obtained by cooling the melted eutectic mixture below its solidification point, contain the most intimate mixture, namely a mutual solution of these components, and exhibit the maximum explosive output, as measured by the depth of dent, for a given RDX (HMX) content. AN/EDD mixtures produced by solidification of the melted mixture, wherein these components are present in other than the eutectic ratio (1:1 weight ratio), contain these components in part as the eutectic (wherein the AN and EDD are contained as a mutual solution) and in part as "excess" or undissolved AN or EDD.

The following examples specifically illustrate explosive compositions of this invention as well as comparative explosive compositions of the prior art. In the examples, parts and percentages reported are by weight.

EXAMPLE 1-33

Table 1 sets forth explosive compositions of the present invention as well as prior art explosive compositions together with the test results which are also plotted in FIG. 2. FIG. 2 also contains test data for explosive compositions not shown in Table 1 but obtained in the same manner.

Section C following the table describes the methods employed for preparing and testing the explosive compositions.

TABLE 1

Results of Confined Small Scale Dent and Detonation Velocity Tests (Explosive Diameter = 9.65 mm)

| Example | TNT | RDX | AN | MAN | EDD | Dens. | Depth of Dent (mm) | | | | Avg. | Det. Vel. (mm/ sec) | | | Avg. |
|---|---|---|---|---|---|---|---|---|---|---|---|---|---|---|---|
| 1 | | 100 | | | | 1.72 | 3.58 | 3.61 | 3.47 | 3.47 | 3.53 | 8.66 | 8.59 | 8.46 | |
| | | | | | | | | | | | | 8.55 | | | 8.57 |
| 2 | 20 | 80 | | | | 1.66 | 3.43 | 3.28 | | | 3.36 | | | | |
| 3 | 40 | 60 | | | | 1.67 | 3.33 | 3.20 | 3.10 | 3.23 | 3.22 | 7.73 | | | 7.73 |
| 4 | 60 | 40 | | | | 1.64 | 2.95 | 2.90 | | | 2.93 | | | | |
| 5 | 80 | 20 | | | | 1.63 | 2.79 | 2.84 | | | 2.82 | | | | |
| 6 | 100 | | | | | 1.59 | 2.53 | 2.57 | 2.41 | 2.46 | | 6.92 | 6.92 | 6.69 | 6.84 |
| | | | | | | | 2.49 | 2.44 | 2.46 | | 2.48 | | | | |
| 7 | | | | 100 | | 1.40 | 0.05 | 0.10 | | | f | | | | |
| 8 | | 60 | | | 40 | 1.67 | 3.25 | 3.18 | | | 3.22 | | | | |
| 9 | | 40 | | | 60 | 1.64 | 2.90 | 2.82 | | | 2.86 | 7.96 | 7.66 | | 7.81 |
| 10 | | 20 | | | 80 | 1.59 | 2.69 | 2.72 | | | 2.71 | 7.56 | 7.52 | | 7.54 |
| 11 | | | | | 100 | 1.55 | 2.72 | 2.46 | 2.59 | 2.64 | 2.60 | 6.77 | | | 6.77 |
| 12 | | 80 | 20 | | | 1.70 | 3.30 | 3.20 | | | 3.25 | | | | |
| 13 | | 60 | 40 | | | 1.73 | 2.69 | 2.77 | | | 2.73 | | | | |
| 14 | | 40 | 60 | | | 1.71 | 1.89 | 1.93 | 2.21 | 2.26 | | 7.17 | 7.17 | 7.12 | 7.15 |
| | | | | | | | 2.26 | | | | 2.11 | | | | |
| 15 | | 20 | 80 | | | 1.66 | 1.19 | 1.22 | | | 1.21 | | | | |
| 16 | | | 20 | | 80 | 1.48 | 2.67 | 2.69 | | | 2.68 | 6.18 | 6.58 | | 6.38 |
| 17 | | | 30 | | 70 | 1.51 | 2.64 | 2.49 | 2.49 | 2.72 | | 5.85 | 5.60 | 5.90 | 5.78 |
| | | | | | | | 2.74 | | | | 2.61 | | | | |
| 18 | | | 40 | | 60 | 1.47 | 2.52 | 2.57 | | | 2.54 | 5.90 | 5.69 | | 5.80 |
| 19 | | | 50 | | 50 | 1.55 | 1.52 | 1.70 | 2.18 | 1.52 | | 5.19 | 5.18 | 5.20 | 5.19 |
| | | | | | | | 0.76 | 0.86 | 1.96 | | 1.50 | | | | |
| 20 | | | 56 | | 44 | 1.58 | 0.91 | 2.13 | 2.72 | 0.40 | | 5.81 | 5.23 | | 5.52 |
| | | | | | | | 1.98 | 2.52 | 0.15 | f | 1.20 | | | | |
| 21 | | | 60 | | 40 | 1.55 | 1.70 | 1.32 | 1.52 | 1.83 | 1.59 | | | | |
| 22 | 70 | | 30 | | | 1.63 | 2.01 | 2.03 | | | 2.02 | 6.48 | 6.25 | | 6.37 |
| 23 | | 40 | 45 | 15 | | 1.66 | 2.97 | 2.97 | 2.96 | | 2.97 | 7.34 | 7.31 | 7.07 | 7.24 |
| 24 | | 40 | 30 | 30 | | 1.62 | 3.05 | 3.07 | 2.99 | | 3.04 | 7.49 | 7.51 | 7.16 | 7.39 |
| 25 | | 40 | 15 | 45 | | 1.57 | 2.97 | | | | 2.97 | 7.57 | | | 7.57 |
| 26 | | 40 | 34 | | 26 | 1.67 | 3.22 | 3.25 | 3.28 | 3.23 | 3.25 | | | | |
| 27 | | 40 | 30 | | 30 | 1.66 | 3.28 | 3.15 | 3.30 | 3.20 | 3.23 | 7.38 | | | 7.38 |
| 28 | | 20 | 60 | | 20 | 1.67 | 2.29 | 2.36 | | | 2.33 | | | | |
| 29 | | 20 | 45 | | 35 | 1.62 | 2.95 | 2.92 | | | 2.94 | 6.16 | | | 6.16 |
| 30 | | 20 | 40 | | 40 | 1.61 | 3.05 | 3.02 | 3.30 | 3.23 | 3.15 | 6.39 | | | 6.39 |
| 31 | | 20 | 24 | | 56 | 1.51 | 2.90 | 2.84 | | | 2.87 | 6.93 | | | 6.93 |
| 32 | 40 | 20 | 40 | | | 1.65 | 2.54 | 2.46 | 2.71 | 2.67 | 2.60 | 7.10 | | | 7.10 |

TABLE 1-continued

| Results of Confined Small Scale Dent and Detonation Velocity Tests (Explosive Diameter = 9.65 mm) | | | | | | | | | | | | |
|---|---|---|---|---|---|---|---|---|---|---|---|---|
| Example | TNT | RDX | AN | MAN | EDD | Dens. | Depth of Dent (mm) | | Avg. | Det. Vel. (mm/ sec) | | Avg. |
| 33 | 40 | | 34 | | 26 | 1.61 | 2.79 | 2.82 | 2.81 | | | |

Compositions given in weight percents.
AN = ammonium nitrate;
MAN = methylammonium nitrate;
EDD = ethylenediamine dinitrate;
Dens. = average density in g/cm$^3$;
f = fails to propagate;
AN = 100 and
AN/EDD = 75/25 did not propagate.

Referring to Table 1 and the graphs shown in FIG. 2, it is noted that the depth of dent decreases steadily as the AN content of the RDX/AN composition is increased. By contrast, with RDX 20/EDD/AN and RDX 40/EDD/AN compositions, wherein the RDX content is held constant at 20% and 40% respectively, it is surprising that the depth of dent curve in each case rises to a peak as the AN content is increased with corresponding decrease of the EDD content. The intersections of these curves with the RDX/AN curve indicate an equivalent depth of dent for the RDX 75/AN25 and RDX40/EDD35/AN25 compositions as well as for the RDX65/AN35 and RDX20/EDD45/AN35 compositions. The curves demonstrate that RDX/EDD-/AN compositions of the present invention containing cosolidified EDD/AN mixtures provide an increased participation of the AN in the explosive output and produce equivalent output with a much lower content of RDX than mixtures of RDX with AN or TNT. Further, a comparison of the curves for RDX40/EDD/AN and RDX40/MAN/AN shows that EDD gives superior results in combination with AN/RDX than does MAN.

Similar results are obtained when part or all of the RDX is replaced by HMX.

B. EXAMPLES 34–39

Figure 1:
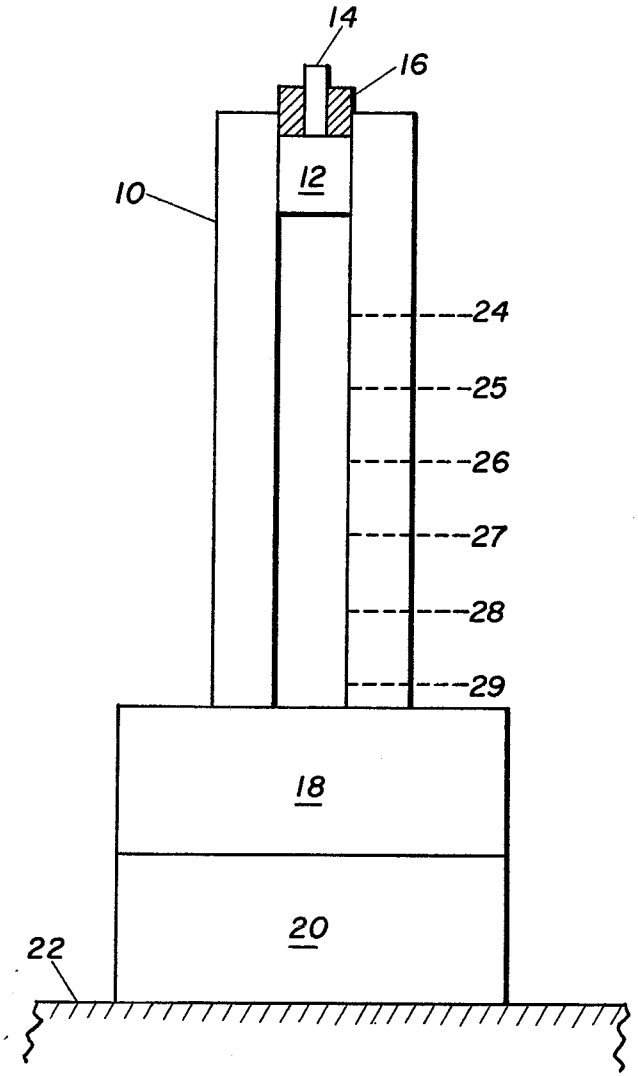
FIG. 1 is a diagrammatic view of apparatus for measuring the denting power of an explosive composition.

Dent and detonation velocity tests with Composition B (RDX/TNT/60/40) and EDD/AN/RDX compositions, prepared in similar manner to that described in section C, were carried out at a larger explosive diameter in apparatus which possessed a similar configuration to that described above and shown in FIG. 1 except as follows:

The explosive pellets had a diameter of 19.2 mm;

The tube (10) had an ID of 19.2 mm, an OD of 50.8 mm and a length of 152 mm;

The distance between the pins (24–29) was twice that in the apparatus of Section C;

The witness plates (18 and 20) were SAE1117 cold drawn steel cylinders (see Metals Handbook 8th Ed. Vol. 1, American Society for Metals, pages 62 and 188) of 101.6 mm diameter and 50.8 mm thickness supported on a pad of 76 mm thick urethane foam on 19 mm thick plywood resting on a steel base.

The test results are set forth in Table 2.

TABLE 2

| Explosive Diameter 19.2 mm | | | | | | | | | | | | | | | |
|---|---|---|---|---|---|---|---|---|---|---|---|---|---|---|---|
| Example | TNT | RDX | AN | EDD | Detonation Velocity (mm/μsec) Individual Values | | | | | Avg. | Density Individual Values | | Depth of Dent (mm) | | Avg. |
| 34 | 40 | 60 | | | 7.688 | 7.885 | 7.673 | | | 7.749 | 1.645 | 1.636 | 7.462 | 7.430 | 7.446 |
| 35 | | 40 | 30 | 30 | 7.390 | 7.412 | 7.372 | 7.566 | 7.769 | 7.502 | 1.634 | 1.637 | 7.551 | 7.945 | 7.748 |
| 36 | | 25 | 37.5 | 37.5 | 7.131 | 7.075 | 6.430 | 6.520 | | 6.789 | 1.645 | 1.642 | 7.767 | 7.874 | 7.821 |
| 37 | | 20 | 40 | 40 | 6.529 | 6.336 | 6.836 | 6.759 | | 6.615 | 1.627 | 1.629 | 8.230 | 7.912 | 8.071 |
| 38 | | 15 | 42.5 | 42.5 | 7.042 | 6.899 | 6.786 | 6.766 | 6.665 | 6.832 | 1.633 | 1.629 | 7.836 | 7.811 | 7.824 |
| 39 | 100 | | | | 6.795 | 6.524 | 6.669 | | | 6.663 | 1.553 | 1.561 | 6.299 | 6.375 | 6.337 |

The results show that the EDD/AN/RDX compositions of the present invention, using much less RDX, are equal or superior to Composition B (example 34) in explosive output, as measured by the aforesaid dent test, notwithstanding their lower detonation velocities.

When the tests were repeated except that the aforesaid witness plates were replaced by two witness plates of CRS 1018 steel, 76.2 mm diameter and 38.1 mm thickness supported on a steel base plate, the EDD-/AN/RDX compositions produced more damage and had a greater shearing effect at the periphery of the explosive column (as shown by the greater depth of dent and extent of cracking of the top witness plate) than the reference explosive RDX/TNT 60/40.

Also, the explosive composition EDD/AN/RDX 37.5/37.5/25, prepared as described in Section C, was tested with a 4 inch 42° copper shaped charge at standoff distances of two and twenty cone diameters, and produced jet parameters and penetration indicating performance equal or superior to that similarly produced with Composition B containing 60% RDX although with a content of only 25% RDX.

From the foregoing it is evident that the compositions of the present invention, containing the aforesaid critical proportions of the low cost, cosolidified complementary explosives EDD and AN in combination with the powerful ideal explosives RDX and/or HMX, provide a synergistic result whereby they produce an unexpectedly high explosive output with a relatively low RDX content and an equal or superior explosive performance with a much lower RDX content as compared with conventional relatively costly explosives containing RDX, such as Composition B.

C. Preparation and Testing of the Explosive Compositions

Preparation of Cosolidified EDD/AN Compositions

The AN (mp 169° C) and EDD (mp 185° C) were weighed and dry-mixed and charged to a flask partially submerged in silicone oil in a larger beaker on a thermostatically controlled hot-plate. A mercury glass thermometer was kept in the silicone oil. For 50/50 (eutectic) mixtures the temperature was kept at 120° C; for the other mixtures the temperature was held at about 140° C for just long enough to melt the materials as visually observed. The melt was then poured into a relatively large quantity of room temperature trichlorotrifluorethane (Freon TF or Genetron 113) with rapid stirring. The spherical beads thus formed, ranging in diameter from less than 1 mm to about 2 mm, were separated from the trichlorotrifluoroethane by filtration and crushed in an electric mortar and pestle to a moderately fine granular size suitable for pressing, namely about 350 microns median particle diameter.

Preparation of EDD/AN/RDX Compositions

The RDX was military grade, Type II, Class A, median particle diameter 250 microns.

The components, RDX and the cosolidified EDD-/AN mixtures obtained as described above, were weighed and then thoroughly mixed in beakers.

Preparation of MAN*/AN/RDX Compositions

These mixtures were made in similar manner to the EDD/AN/RDX mixtures.

* MAN is methyl ammonium nitrate, mp 109°-110° C.

Other Compositions

The RDX/AN and RDX/EDD mixtures were prepared by dry-mixing the RDX with AN or EDD ground to the usual size in the mortar and pestle.

The TNT/AN formulations were made by mixing the finely ground AN with a solution of the TNT in toluene, and evaporating the solvent with a dry nitrogen sweep over the surface. The product was lightly crushed to break up small, soft lumps.

Fabrication and Assembly for Confined Small Scale Detonation Velocity and Depth of Dent Tests All compositions were pressed in a die of 9.525 mm inner diameter, unheated, unevacuated, at about 3800 kg/cm$^2$ with a dwell of about two minutes. Length of pellet varied from 6 to 12 mm. Density was measured soon after pressing, by weighing to 0.1 milligram and measuring diameter and length by micrometer to the nearest 0.0025 mm. Density was also measured again prior to assembly into shot tubes because it had been found that some pellets would not fit into the 9.652 mm ID of the tubes due to spring-back. This was quite significant, especially in the EDD/AN formulations and in pure EDD. Because of this factor and occasional slight irregularity of pellets (corner chipped, etc.) density results were rounded from the nearest milligram/cc to the nearest 0.01 gm/cc.

The tube (10) for the confined small-scale detonation velocity and dent tests (FIG. 1) was a steel cylinder 76.2 mm long with 25.4 mm OD and 9.65 mm ID. Pellets were assembled into this tube with a pellet near the average density of the stack placed next to the witness plate. Those pellets whose density differed most from the average were placed nearest the detonator. Additive height was checked against height in tube to avoid gaps. Pellets that could not be inserted as they were because of spring-back were first lightly abraded dry. All pellets fitted quite tightly. In no case would there have been radial gaps greater than 0.025 mm.

A booster pellet (12), normally Composition B (RDX/TNT 60/40) was placed in the tube and an exploding bridgewire (EBW)detonator (14) in a plastic holder (16) was glued in with a drop of cyanoacrylate adhesive or fast-setting epoxy.

Two witness plates (18) and (20), each of SAE1018 cold drawn (see Metals Handbook 8th Ed. Vol. 1, American Society for Metals pp 62 and 188), 50.8 × 50.8 × 17 mm were adhered together with a drop of cyanoacrylate and the loaded tube was similarly adhered to it, taking care not to touch the explosive with the adhesive. All surfaces were flat to better than 0.025 mm and the nature of the adhesive assured flatness and contact, as it will not set except in thin layers. Two witness plates were used because with powerful explosives small tensile cracks were found in the first few shots when only one witness plate was employed.

The assembly was then placed in a special chamber able to confine the shock, blast, and debris. The assembly rested vertically with the witness plates on thick foamed polyethylene or foamed polyurethane (22). The six pin wires (24–29) for measuring detonation velocity D, when used, were connected, as was the coaxial detonator firing cable. The chamber was closed and the shot fired behind blast doors in an explosives safety hood.

Detonation Velocity (D)

The D records were obtained from the output signals from the pins (see FIG. 1) by the following combination of instruments. The pin mixer circuit output was put into a channel of a transient digitizer (Biomation Model 8100 marketed by Biomation Co., Cupertino, California) that provides 2,000 samplings at a variable preselected sampling rate. The smallest sampling interval, 10 nanoseconds, was used. The input voltage is measured, digitized and "memorized" at each of these intervals. Output is a voltage proportional to the digitized value (the digitalization is for storage purposes) and the time of output is 20 seconds for the 2,000 points. The output was connected to a galvansmeter of a Honeywell Visicorder (paper) oscillograph, Model 906C (marketed by Honeywell, Inc., Test Instrument Div., Denver, Colorado) — set to run at 127 mm per second. Simultaneously, outputs of a time-mark generator, Tektronix Model 184 (marketed by Tektronix, Inc., Beavertown, Oreg.), at 1 second, 0.1 second, and 0.01 second were parallelled at successively lower voltages and connected to another of the oscillograph's galvanometers. These gave crystal-controlled time marks along the paper at what are effectively 1 microsecond, 0.1 microsecond and 0.01 microsecond (10 nanoseconds) because the digitizer playback time of 20 seconds is $10^6$ times as long as the input sampling time (2,000 × 10 ns). The digitizer oscillator is also crystal controlled at high accuracy, similar to the time-mark generator.

The oscillograph paper, UV-light activated, develops in fluorescent room lighting in a minute or so. Reading the time interval between pin signals then is simply a matter of counting the time marks between signals. Precision and accuracy is 10 ns, with no linearity or reading error greater than that. The space interval between pins was a constant 9.525 mm ± 0.013 mm (as a tolerance; dispersion was actually lower). D thus had an intrinsic resolution in one space interval not statistically poorer than about 25 m/s. Other potential sources of error (e.g. pin not fully inserted and touching the explosive) can make individual interval error greater than that. But averaging over several intervals or considering several intervals as a larger one increases the proportional accuracy, so that the overall statistical precision and accuracy was on the order of 10–15 m/s. All the values obtained were rounded to the nearest 10 m/s.

Depth of Dent

After the shot, it was always found that the two thicknesses of the witness plate had come apart. The upper piece was measured for dent depth by dial indicator with a small-radius tip, reading to the nearest 0.025 mm. The witness plate was put on a flat surface plate and the dial indicator zeroed to the upper surface of the witness plate by trials at the midpoints of the four edges. There was usually some overall curvature (concavity of the top, convexity of the bottom) especially in those dented the deepest; and sometimes there was edge damage from collision with the chamber or other plate after separation, etc. The effects of these distortions were avoided by care in the zeroing process. Depth of dent was then measured to the deepest point, without regard to its width. The deepest point was in the center of the dent and was usually of small width. Sometimes the deepening toward the center was gradual over much of the total width. Lip height was read a number of times, but, like the few volume measurements tried, seemed to be an irregular or insensitive measurement, possibly due to inadequate precision in the measurement.

We wish it to be understood that we do not desire to be limited to the exact details of construction shown and described, because obvious modifications will occur to a person skilled in the art.

We claim:

1. An explosive composition consisting essentially of a mixture of 15 to 45% by weight of a particulate high explosive selected from the group consisting of 1,3,5-trinitro-1,3,5-triazacyclohexane and 1,3,5,7-tetranitro-1,3,5,7-tetraazacyclooctane, and mixtures thereof;

15 to 50% by weight of ammonium nitrate; and 20 to 60% by weight of ethylenediamine dinitrate; wherein the ammonium nitrate and the ethylenediamine dinitrate are present in the weight ratio of from 1:2.5 to 1.5:1, respectively, as an intimate mixture of which the major portion is obtained by cosolidification.

2. The explosive composition of claim 1, wherein substantially all of said ammonium nitrate and ethylenediamine dinitrate are present as an intimate mixture obtained by cosolidification.

3. The explosive composition of claim 2, wherein the ammonium nitrate and ethylenediamine dinitrate are present in essentially the eutectic weight ratio of about 1:1 as an intimate mixture obtained by cosolidification of a molten mixture thereof.

4. The explosive composition of claim 3, obtained by heating the mixture in an inert carrier liquid to a temperature above the melting point of the eutectic mixture of ethylenediamine dinitrate and ammonium nitrate, and cooling the mixture to solidify said eutectic mixture largely as a coating on the particles of the high explosive.

5. The explosive composition of claim 3, wherein the high explosive amounts to about 40% by weight of the mixture.

6. The explosive composition of claim 1, wherein the high explosive is 1,3,5-trinitro-1,3,5-triazacyclohexane.

7. A cast explosive of the composition of claim 1.

8. A pressed explosive of the composition of claim 1.

* * * * *